United States Patent [19]

Suzuki et al.

[11] Patent Number: 4,875,832

[45] Date of Patent: Oct. 24, 1989

[54] PRESSURE CONTROL VALVE FOR VARIABLE DISPLACEMENT SWASH PLATE TYPE COMPRESSOR

[75] Inventors: Nobuhiko Suzuki, Konan; Tetuya Aoki, Setagaya, both of Japan

[73] Assignees: Diesel Kiki Co., Ltd.; Fujikoki Manufacturing Co., Ltd., both of Tokyo, Japan

[21] Appl. No.: 286,121

[22] Filed: Dec. 19, 1988

[30] Foreign Application Priority Data

Dec. 28, 1987 [JP] Japan ..... 62-336641

[51] Int. Cl.[4] ..... F04B 1/26; F16K 31/02

[52] U.S. Cl. ..... 417/222; 251/129.17; 251/129.18; 417/270

[58] Field of Search ..... 251/129.15, 129.17, 251/129.18; 417/222 S, 270

[56] References Cited

U.S. PATENT DOCUMENTS

| | | | |
|---|---|---|---|
| 4,530,486 | 7/1985 | Rusnak | 251/129.15 |
| 4,688,997 | 8/1987 | Suzukio et al. | 417/270 |
| 4,730,986 | 3/1988 | Kayukawa et al. | 417/270 |
| 4,747,754 | 5/1988 | Fujii et al. | 417/222 S |
| 4,780,059 | 10/1988 | Taguchi | 417/270 |

FOREIGN PATENT DOCUMENTS

| | | | |
|---|---|---|---|
| 698160 | 11/1964 | Canada | 251/129.18 |
| 255764 | 2/1988 | European Pat. Off. | 417/222 S |
| 2347559 | 9/1973 | Fed. Rep. of Germany | 251/129.15 |

*Primary Examiner*—William L. Freeh

*Attorney, Agent, or Firm*—Wenderoth, Lind & Ponack

[57] ABSTRACT

A pressure control valve for a variable displacement swash plate type compressor includes a valve element movable under a combined force of the force of a pressure responsive member and the force of a solenoid. The valve element is engageable with a valve seat which is positionally adjustably mounted on a valve case of the pressure control valve and movable in the direction of movement of the valve element. The solenoid includes an armature to which an adjustment screw is threadedly connected. The extent of the adjustment screw which projects from the armature is adjustable so that the position of the valve element is adjustable relative to the valve seat. With this arrangement, it is possible to adjust the pressure controlling characteristics exactly.

2 Claims, 4 Drawing Sheets

PRESSURE CONTROL VALVE FOR VARIABLE DISPLACEMENT SWASH PLATE TYPE COMPRESSOR

BACKGROUND OF THE INVENTION

1. Field of the Invention

The present invention relates to a pressure control valve for use with a variable displacement swash plate type compressor for regulating the amount of gas relief from a crank chamber to an intake chamber.

2. Description of the Related Art

There are known various pressure control valves of the type which include a valve element actuated by a pressure responsive member exposed to an intake pressure, and a solenoid for controlling the movement of the valve element in such a manner that the degree of communication between a crank chamber and an intake chamber of a compressor is adjusted according to the electric current intensity supplied to the solenoid. One example of such known pressure control valves includes, as shown here in FIG. 6 of the accompanying drawings, a valve case 28, a valve holder 29 firmly connected to one end of the valve case 28 and receiving therein a valve element 42 and a pressure responsive member 44 connected to the valve element 42. The valve holder 29 has an axial connecting hole 38 and a radial connecting hole 29 opening respectively to a crank chamber 4 and an intake chamber 27 of a compressor. The valve holder 38 includes a valve seat 40 formed at an inner end of the connecting hole 38 for engagement with the valve element 42. The pressure responsive member 44 is subjected to the pressure in the intake chamber 27. The valve element 42 is held in abutment with a stem 41 which is connected with an armature 32 of a solenoid 30 through a connecting pin 56 and a connecting rod 55. The armature 32, connecting rod 55 and connecting pin 56 extend centrally through an annular stator 33 of the solenoid 30. The armature 32 and the stator 33 have tapered confronting surfaces. When an electromagnetic coil 31 is energized, a magnetic force is produced between the armature 32 and the stator 33, tending to move the armature 32 rightward in this figure to thereby urge the valve element 42 toward the valve seat 40.

The pressure control valve of the foregoing construction is however disadvantageous in that the hysteresis between the intake pressure due to an increasing and a decreasing electric current supply to the electromagnetic coil is large, as indicated by broken lines shown in FIG. 4. The reproducibility of the pressure control valve is therefore very low.

The foregoing drawback is caused mainly by the abutment engagement between the valve element and the stem. With this abutment engagement, it is difficult to guide the valve element accurately in a direction parallel to the axis of the stem when the control valve is subjected to vibration. The valve element is hence likely to be seated unstably on the valve seat and also to produce a large amount of friction between itself and the valve seat. Another factor lowering the reproducibility is that the cumulative tolerance of the stem, valve element and valve holder and the mounting error of the pressure responsive member vary the distance between the armature and the stator and also alter the characteristics of the pressure responsive member.

SUMMARY OF THE INVENTION

It is accordingly an object of the present invention to provide a pressure control valve for a variable displacement swash plate type compressor, which has only a small hysteresis or difference between the intake pressure to an increasing and a decreasing electric current supply to an electromagnetic coil and, consequently, has excellent reproducibility.

Another object of the present invention is to provide a pressure control valve for a variable displacement swash plate type compressor, which is capable of adjusting the pressure controlling characteristics exactly.

According to the present invention, there is provided a pressure control valve for a variable displacement swash plate type compressor, comprising: a valve case; a valve element movably disposed in the valve case for adjusting the degree of communication between a first connection hole which is defined in the valve case and opens to a crank chamber in the variable displacement swash plate type compressor, and a second connection hole which is defined in the valve case and opens to an intake chamber in the variable displacement swash plate type compressor; a pressure responsive member disposed in the valve case and operatively connected to the valve element for displacing the valve element in response to the pressure in the intake chamber; a solenoid disposed in the valve case for controlling the movement of the valve element and including an electromagnetic coil, a stator and an armature; a stem secured to the valve element and reciprocally received in a guide hole defined in the stator; an adjustment screw disposed between the stem and the armature and axially movable to adjust an extend of the adjustment screw which projects from the armature; and a valve seat disposed on the valve case for engagement with the valve element and movable in the same direction as the movement of the stem.

With this construction, the valve element is secured to the stem movably received in the guide hole in the stator with the result that the valve element is guided accurately in the axial direction of the stem and can be brought into mutual engagement with the valve seat. Since the armature and the stem are interconnected by the adjustment screw, the distance between the armature and the stator is adjustable by varying the extent of the adjustment screw which projects from the armature. Furthermore, the characteristics of the pressure responsive member is variable by adjusting the position of the valve seat.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION OF THE INVENTION

Certain preferred embodiments of the present invention will be described hereinbelow in detail with reference to the accompanying drawings.

Figure 3:
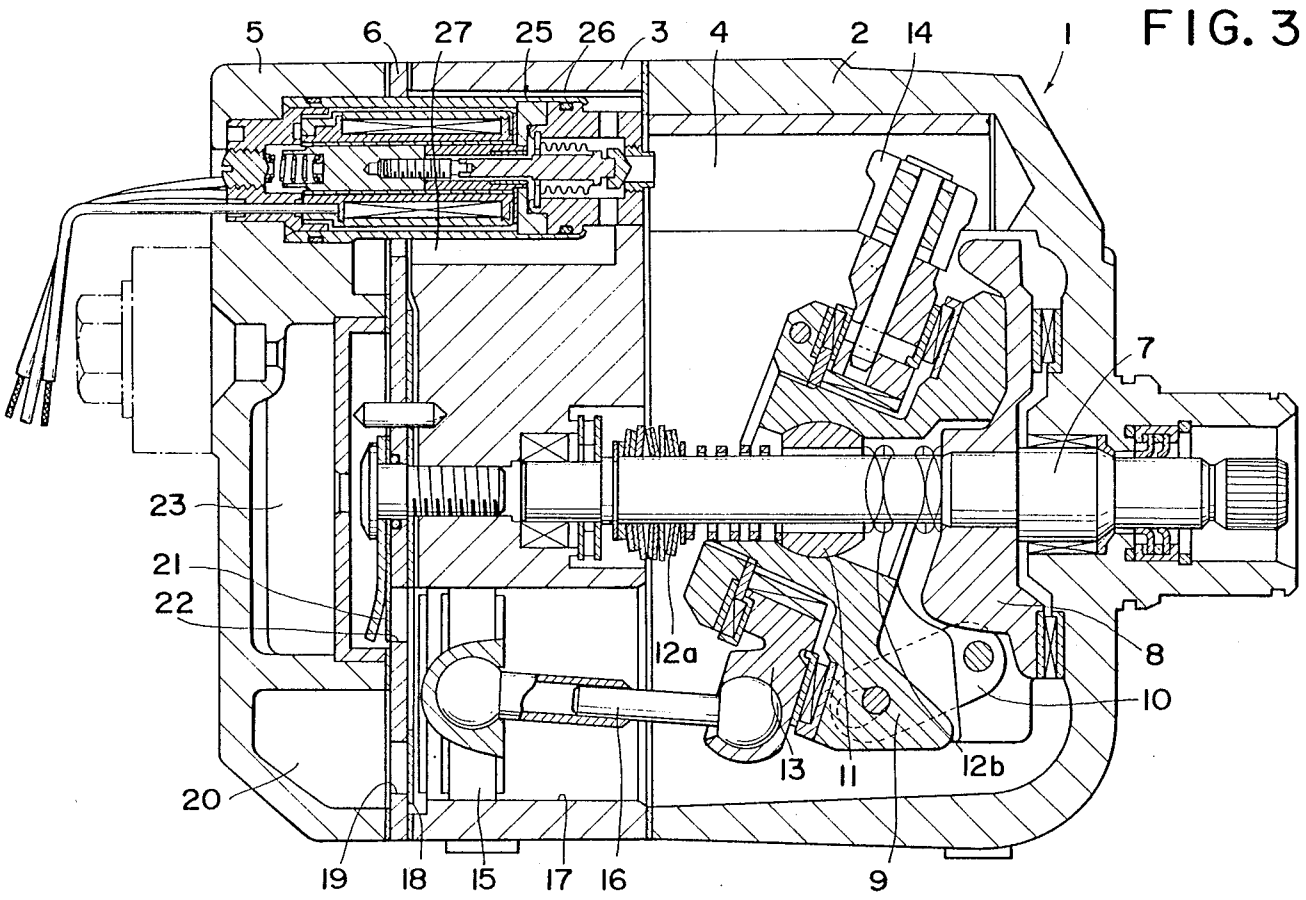
FIG. 3 is a longitudinal cross-sectional view a variable displacement swash plate type compressor in which the pressure control valve is incorporated.

As shown in FIG. 3, a variable displacement compressor 1 is of the swash plate or wobble plate type and includes a cup-shaped housing 2 and a cylinder block 3 connected to an open end of the cup-shaped housing 2 so as to define therebetween a crank chamber 4. To the outer end of the cylinder block 3, a cylinder head 5 is connected with a valve plate 6 disposed between the cylinder block 3 and the cylinder head 5.

A drive shaft 7 is rotatably supported by the housing 2 and the cylinder block 3 and firmly connected to a thrust flange 8 which is rotatably supported by the housing 2 within the crank chamber 4. The thrust flange 8 is pivotally connected to a drive hub 9 via a link 10. The drive hub 9 is disposed in the crank chamber 4 and rotatably and pivotably supported on a hinge ball 11. The hinge ball 11 is urged on its opposite sides by a pair of resilient members 12*a*, 12*b* disposed on and around the drive shaft 7.

A swash plate or wobble plate 13 is movably supported within the crank chamber 4 by the drive hub 9. The wobble plate 13 is also held in engagement with the housing 2 via a slider 14 so that the wobble plate 13 is pivotable about the hinge ball 11 relative to the housing 2. The wobble plate 13 is connected with a plurality of pistons 15 via respective piston rods 16. Each of the pistons 16 is slidably received in a cylinder bore 17 defined in the cylinder block 3. There is defined between the valve plate 6, the piston 16 and the peripheral wall of the cylinder bore 17, a compression chamber. The compression chamber is in communication with a low pressure chamber 20 in the cylinder head 5 through an intake hole 19 in the valve plate 6 when an intake valve 18 is opened during the intake stroke of the piston 15. While the piston 15 is in the discharge stroke, a discharge valve 21 is opened to communicate the compression chamber with a high pressure chamber 23 via a discharge hole 22 in the valve plate 6, the high pressure chamber 23 being defined in the cylinder head 5 independently of the low pressure chamber 20. The low pressure chamber 20 and the high pressure chamber 23 are connected respectively with an intake port (not shown) and a discharge port (not designated) which are defined in the cylinder head 5.

A pressure control valve 25 embodying the present invention is immovably received in a control valve-receiving hole 26 extending axially through the cylinder block 3, the valve plate 6, and the cylinder head 5. The cylinder block 3 has defined therein an intake chamber 27 extending around the pressure control valve 25 and communicating with the low pressure chamber 20. The structure of the pressure control valve 25 is illustrated in FIGS. 1 and 2.

Figure 1:
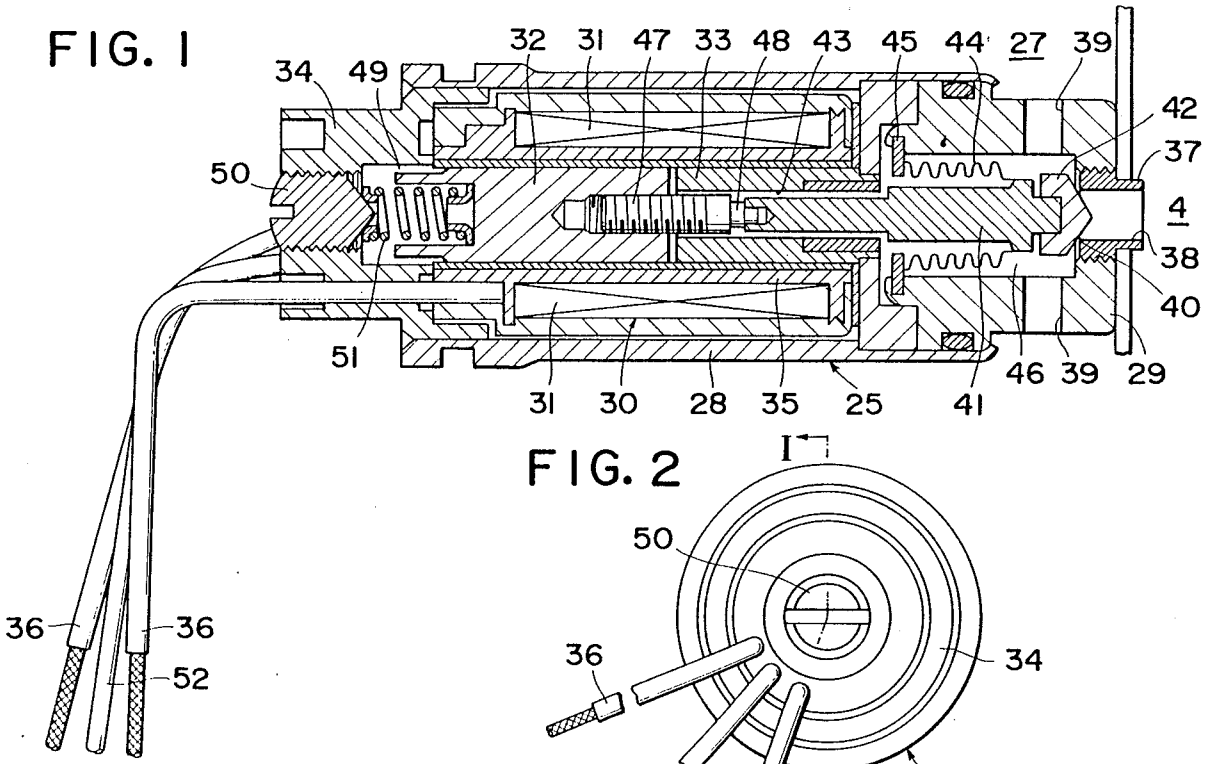
FIG. 1 is a longitudinal cross-sectional view taken along line I—I of FIG. 2, showing a pressure control valve according to the present invention.
Figure 2:
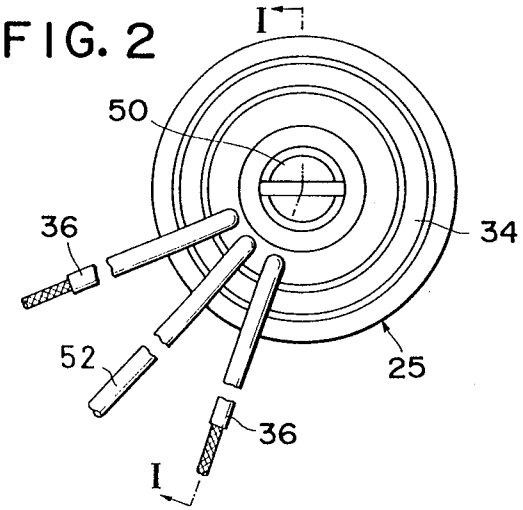
FIG. 2 is an end view of the pressure control valve.

As shown in FIGS. 1 and 2, the pressure control valve 25 includes a valve case 28, a valve holder 29 secured to one end of the valve case 28 and a solenoid 30 disposed in the valve case 28. The solenoid 30 is composed of an electromagnetic coil 31, an armature 32 and a stator 33. The armature 32 is movable relative to the valve case 28 in the axial direction thereof while the stator 33 is immovably connected to the valve case 28. The armature 32 and the stator 33 have confronting non-tapered flat surfaces. The other end of the valve case 28 is connected to an end cap 34 through which lead wires 36, 36 are connected to the electromagnetic coil 31 wound on a coil bobbin 35 for energization and de-energization of the electromagnetic coil 31. When the electromagnetic coil 31 is energized, the armature 32 is attracted toward the stator 33, thereby displacing a valve element 42 (described below) toward a valve seat 37 (described later on) to an extent which is corresponding to an intensity of the supply current.

Since the armature 32 and the stator 33 have confronting non-tapered flat surfaces, the direction of force acting on the armature 32 is identical to the direction of the movement of the armature 32, a stem 41 and the valve element 42 and, consequently, most of the force is transmitted from the armature 32 to the valve element 42 via the stem 41. Conversely, if the confronting surfaces were tapered, a component of force acting on the armature 32 in a direction perpendicular to the axis of the armature 32 would increase to thereby produce a great frictional resistance.

The valve holder 29 has at its one end an internally threaded hole into which an externally threaded valve seat 37 is threaded for positional adjustment relative to the valve holder 29. The valve seat 37 has a first connection hole 38 through which the crank chamber 4 communicates with a pressure responsive member-receiving chamber 46 defined in the valve holder 29. The valve holder 29 has a second connection hole 39 extending diametrically across a peripheral wall of the valve holder 29 and connected to the intake chamber 27.

The first connection hole 38 is connected at its inner end with an annular valve seat surface 40 against which the puppet-like valve element 42 is adapted to be seated. The vavle element 42 is firmly connected to a front end of the stem 41. The rear end of the stem 41 is slidably received in a central guide hole 43 in the stator 33. Thus, the stem 41 is movable only in the axial direction thereof so that the valve element 42 is forced by the stem 41 to uniformly engage the valve seat surface 40 without causing undesired wobbling. The stem 41 is connected with a pressure responsive member 44 comprising a bellows, for example. The pressure responsive member or bellows 44 is soldered at its one end to a stepped portion of the stem 41 formed adjacent to the front end of the stem 41, the other end of the bellows 44 being soldered to a ring washer 45 clinched to an inner end of the valve holder 29. The pressure responsive member 44 thus connected is disposed in the pressure responsive member-receiving chamber 46. The pressure responsive member 44 has a self-setting or -supporting force and also is pre-loaded by a biasing spring 51 and contractible in response to an increase in the intake pressure so as to displace the valve element 42 leftward in FIG. 1 against the force of the biasing spring 51.

The armature 32 is provided with an adjustment screw 47 threaded to an end of the armature 32. The extent of the adjustment screw 47 which projects from the armature 32 is adjustable and is slidably received in the central guide hole 43 in the stator 33. The adjustment screw 47 is made of a rigid material such as stainless steel and held in abutment with an end of a bush 48, the other end of which is firmly fitted in the rear end of the stem 41. The bush 48 is made of a rigid material which is the same as the adjustment screw 47. This indirect connection between the adjustment screw 47 and the stem 41 is employed in view of the fact that the stem 42, generally formed of a material of high solderability such as brass, is likely to wear out due to repeated adjustment or turning of the adjustment screw 47 while the pressure control valve 25 in use. With this abrasion wear, the characteristics of the control valve 25 is altered even with compensation or correction by means of the valve seat.

The rear end of the armature 32 is loosely received in the end cap 34 with an annular space 49 defined therebetween so that there is no friction produced between the armature 32 and the end cap 34. The biasing spring 51 acts between the end cap 34 and the armature 32 for urging the latter rightward in FIG. 1. The force of the biasing spring 51 is adjustable by turning a spring adjustment screw 50 threaded into the end cap 34.

With this construction, the valve element 42 is held in a position in which the self-supporting force of the bellows 44, the intake pressure acting on the bellows 44, the magnetic force produced by the solenoid 30 and the force of the biasing spring 51 are balanced. When the solenoid 30 is de-energized, the valve element 42 is separated from the valve seat 37 as shown in FIG. 1. When the solenoid 30 is energized and as the intensity of the electric current supply to the solenoid 30 is increased, the magnetic force produced by the solenoid 30 increases. With this increasing magnetic force, the valve element 42 is displaced rightward to reduce the degree of communication between the crank chamber 4 and the intake chamber 27, thereby decreasing the leakage of a refrigeration gas from the crank chamber 4 to the intake chamber 27. As a result, the pressure in the crank chamber 4 is increased due to a blow by gas, i.e. the refrigeration gas which flows through a clearance between the piston 15 and the respective cylinder bore 17. With this pressure rise, the force acting on the rear end of the piston 15 increases to thereby cause the wobble plate 13 to pivotally move about the hinge ball 11 in a direction to reduce the angle of inclination. Thus, the stroke of the piston 15 and, consequently, the displacement of the compressor is reduced.

Designated by the numeral 52 is a tube withdrawn through the end cap 34 together with the lead wires 36 for leading the inside of the pressure responsive member 44 to the atmosphere to thereby equalize the inside pressure of the pressure responsive member 44 and the atmosphere. With this pressure equilibrium, the pressure responsive member 44 is protected from causing a characteristic change which would otherwise occur when the inside pressure of the pressure responsive member 44 is increased with the increase in temperature in the pressure control valve 25. Yet, it is also possible to prevent intrusion of water and dust into the pressure control valve 25 by adequately adjusting the direction of the withdrawal of the tube 52.

Figure 4:
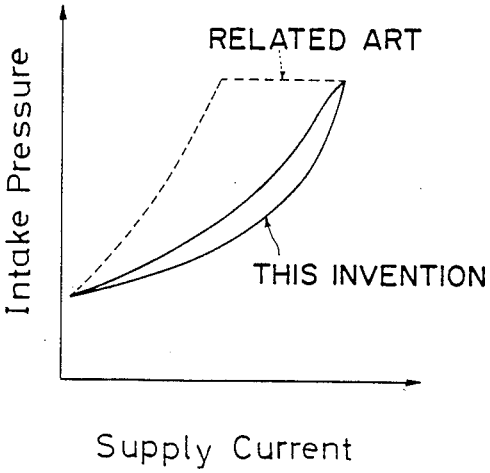
FIG. 4 is a characteristic graph showing the intake pressure obtained when controlling the pressure control valve by a solenoid.
Figure 6:
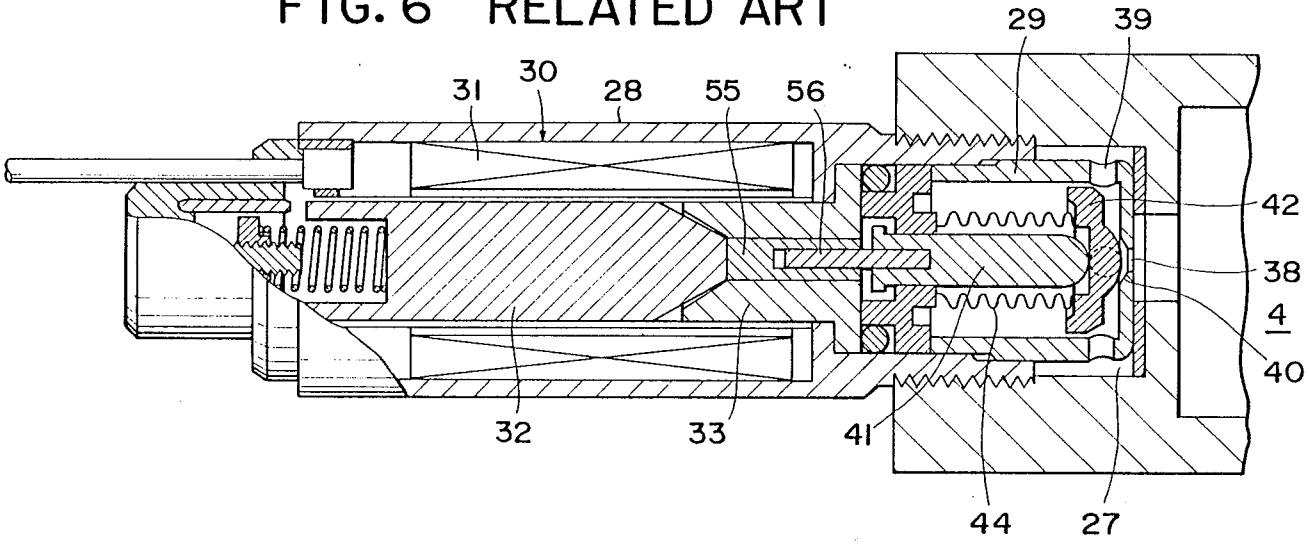
FIG. 6 RELATED ART
FIG. 6 is a longitudinal cross-sectional view of a conventional pressure control valve.

Partly because the valve element 42 is brought into and out of contact with the valve seat surface 40 by the stem 41 which is received in the central guide hole 43 in the stator 33, partly because the armature 32 and the stator 33 have confronting flat surfaces engagable with each other, and partly because the rear end of the armature 32 is separated from the end cap 34 with the large clearance 49 defined therebetween, a substantially friction-free movement of the valve element 41 can be achieved. The valve seat 37 is positionally adjustable to displace the valve seat surface 40, thereby adjusting the initial displacement of the pressure responsive member 44 (namely, the distance between the valve element 41 and the valve seat surface 40). Furthermore, by turning the adjustment screw 47, the distance between the armature 32 and the stator 33 can be adjusted. As a consequence, the hysteresis between the intake pressure to an increasing and a decreasing current supply to the electromagnetic coil 31 becomes considerably smaller as indicated by solid lines shown in FIG. 4. The degree of communication between the crank chamber 4 and the intake chamber 27 can be controlled substantially in direct proportion to the current supply.

Figure 5:
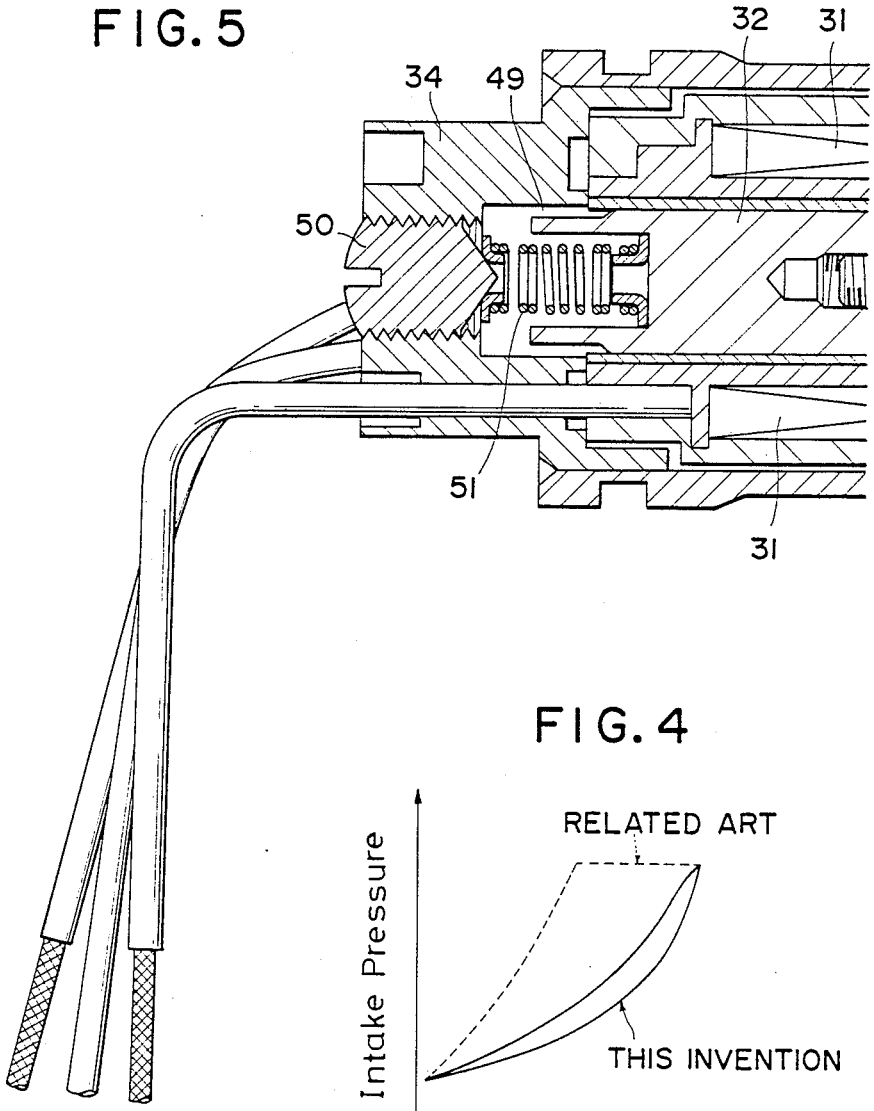
FIG. 5 is a fragmentary cross-sectional view showing a modified spring of the pressure control valve.

The biasing spring 51 of the foregoing embodiment is in the form of a compression coil spring having a single end turn. It is possible to replace this spring 51 with a modified biasing spring 51 shown in FIG. 5. The modified spring 51 comprises a compression coil spring having reinforced opposite end portions each having a tightly fitted multi-turn structure. The biasing spring 51 having such reinforced end portions contributes to minimize the hysteresis of the intake pressure relative to the current supply.

Obviously, various modifications and variations of the present invention are possible in the light of the above teaching. It is therefore to be understood that within the scope of the appended claims the invention may be practiced otherwise than as specifically described.

What is claimed is:

1. A pressure control valve for a variable displacement swash plate-type compressor, comprising:

a valve case including a first connection hole for communicating with a crank chamber and a second connection hole for communicating with an intake chamber;

an end cap secured to said valve case;

a valve element disposed within said valve case and movable along an axis for adjusting the degree of communication between said first and said second connection holes;

a valve seat for engagement with said valve element, said valve seat being mounted on said valve case for adjustment along said axis;

a solenoid for controlling the movement of said valve element, said solenoid including:

an electromagnetic coil disposed within said case;

a stator connected to said coil and including a through-hole one end of said stator having a substantially planar surface disposed substantially normal to said axis;

armature means mounted for reciprocation with respect to said coil, at least a portion of a front end of said armature means having a substantially planar surface disposed normal to said axis and confronting said one end of said stator, a rear end of said armature means being loosely received with radial clearance in said end cap;

a biasing spring extending between said rear end of said armature means and said end cap for biasing said armature means toward said stator;

a stem secured to said valve element at a front end of said stem and extending through said through-hole, a rear end of said stem contacting said armature means; and a bellows for displacing said valve element along said axis in response to the pressure in said intake chamber, said bellows including a first end connected to said stem and a second end connected to said valve case, the interior of said bellows communicating with the atmosphere to equalize the pressure within said bellows.

2. A valve as in claim 1, wherein said biasing spring is a helical compression spring having multi-turn ends.

* * * * *